US011517165B2

(12) United States Patent
Lee et al.

(10) Patent No.: US 11,517,165 B2
(45) Date of Patent: Dec. 6, 2022

(54) CLEANER

(71) Applicants: LG ELECTRONICS INC., Seoul (KR); INDUSTRY-UNIVERSITY COOPERATION FOUNDATION HANYANG UNIVERSITY, Seoul (KR)

(72) Inventors: Seungyeop Lee, Seoul (KR); Kietak Hyun, Seoul (KR); Changgun Lee, Seoul (KR); Sejin Yook, Seoul (KR); Junhyung Lim, Iksan-si (KR)

(73) Assignees: LG ELECTRONICS INC., Seoul (KR); INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 85 days.

(21) Appl. No.: 16/945,205

(22) Filed: Jul. 31, 2020

(65) Prior Publication Data

US 2021/0212538 A1 Jul. 15, 2021

(30) Foreign Application Priority Data

Jan. 13, 2020 (KR) ..... 10-2020-0004419

(51) Int. Cl.
*A47L 9/16* (2006.01)
*A47L 9/10* (2006.01)
(Continued)

(52) U.S. Cl.
CPC ..... *A47L 9/1641* (2013.01); *A47L 9/009* (2013.01); *A47L 9/102* (2013.01); *A47L 9/122* (2013.01);
(Continued)

(58) Field of Classification Search
CPC ..... A47L 2201/00; A47L 2201/024; A47L 9/102; A47L 9/106; A47L 9/1608;
(Continued)

(56) References Cited

U.S. PATENT DOCUMENTS

2001/0018865 A1* 9/2001 Wegelin ..... A47L 9/122 55/472
2013/0081224 A1* 4/2013 Van Der Kool ..... B01D 46/10 15/349
(Continued)

FOREIGN PATENT DOCUMENTS

CN 201008534 Y 1/2008
JP 2945359 B2 9/1999
(Continued)

OTHER PUBLICATIONS

Korean Office Action in Korean Application No. 10-2020-0004419, dated Feb. 4, 2021 (6 pages).
(Continued)

*Primary Examiner* — Joseph J Hail
*Assistant Examiner* — Robert C Moore
(74) *Attorney, Agent, or Firm* — Birch, Stewart, Kolasch & Birch, LLP

(57) ABSTRACT

A cleaner is disclosed, which comprises a main body including an suction inlet through which air containing dust enters, a dust separator provided to separate dust from the air while the air entering from the suction inlet is moving, a first dust
(Continued)

collector configured to collect the dust separated by the dust separator, a cyclone portion configured to rotate the air to separate the dust from the air, and a second dust collector collecting the dust separated by the cyclone portion. The dust separator is provided with a plurality of plate shaped members arranged at a predetermined angle with respect to a moving direction of the air, and arranged to be spaced apart from one another to move the air.

9 Claims, 8 Drawing Sheets

(51) Int. Cl.
*A47L 9/28* (2006.01)
*A47L 9/00* (2006.01)
*A47L 9/12* (2006.01)

(52) U.S. Cl.
CPC ..... *A47L 9/1608* (2013.01); *A47L 9/1683* (2013.01); *A47L 9/2826* (2013.01); *A47L 9/2852* (2013.01); *A47L 2201/04* (2013.01)

(58) Field of Classification Search
CPC ..... A47L 9/1625; A47L 9/165; A47L 9/1641; A47L 9/122; A47L 9/1683; B01D 45/08; B01D 45/02
See application file for complete search history.

(56) References Cited

U.S. PATENT DOCUMENTS

2014/0360362 A1* 12/2014 Peters ..... F01N 3/037 55/338.1
2018/0055317 A1* 3/2018 Hyun ..... B04C 9/00
2018/0177367 A1* 6/2018 Amaral ..... A47L 9/102

FOREIGN PATENT DOCUMENTS

JP 4942573 B2 5/2012
KR 1990-0006327 7/1990
KR 10-2019-0108358 9/2019
KR 10-2021835 9/2019
TW 201932063 A 8/2019

OTHER PUBLICATIONS

PCT International Search Report in Application No. PCT/KR2020/010544, dated Feb. 16, 2021 (12 pages).
Taiwanese Office Action in corresponding Application No. 109131165, dated Aug. 18, 2021 (6 pages).
Korean Office Action in Korean Application No. 10-2020-0004419, dated Apr. 22, 2021 (6 pages).

* cited by examiner

CLEANER

CROSS-REFERENCE TO RELATED APPLICATIONS

This application claims the benefit of priority to Korean Patent Application No. 10-2020-0004419, filed on Jan. 13, 2020, which is hereby incorporated by reference as if fully set forth herein.

TECHNICAL FIELD

The present disclosure relates to a cleaner.

BACKGROUND ART

Modern people get help from electronic appliances in daily life. A user may actively and quickly perform a specific task more conveniently by using the electronic appliances.

This is equally applied to a case even when a user performs cleaning. An upright type cleaner that may perform cleaning for user's convenience even in a state that it is upright, a handy type cleaner with a small storage space, which may easily clean a narrow space, and a robot cleaner that may perform self-cleaning without user's time allocation are commonly used.

Start and end of cleaning in the robot cleaner may be controlled by a user's voice, a user's motion or a user's direct button input. Also, the robot cleaner is a cleaner in which a user's convenience is maximized because a user does not need to continue to grasp the cleaner.

With the development of industry, consumers' eye level is rising day by day. In the prior art, although a method for separating dust through one cyclone in the same manner as a patent reference 1 is adopted, problems occur in that separation performance is deteriorated and a filter should be exchanged if a single cyclone is used.

Moreover, although a patent reference 2 discloses a cleaner for separating dust in due order, problems occur in that it is difficult to perform effective cleaning if a filter is blocked and a direct connection structure from a suction inlet to a motor is required.

DISCLOSURE

Technical Problem

According to the embodiments of the present disclosure, an object of the present disclosure is to provide a cleaner having high utility in an inner space of a main body.

Another object of the present disclosure is to provide a cleaner having easiness in manufacture and high utility in an inner space of a main body by simply forming a structure for primarily separating dust.

Still another object of the present disclosure is to provide a cleaner having excellent dust separation performance even in the case that an inlet and a motor for air flow are not arranged in a direct connection manner.

Further still another object of the present disclosure is to provide a cleaner that may prevent cleaning efficiency from being deteriorated by primarily separating dust through a simple structure and allowing the separated dust to join a flow of the air.

Technical Solution

To achieve the objects of the present disclosure, a cleaner that may change its shape if necessary in such a manner that a primary dust separation structure and a secondary dust separation structure are arranged separately from each other instead of concentric arrangement.

Therefore, since a height of the cleaner may be lower than that of a cleaner in which a primary dust separation structure and a secondary dust separation structure are concentrically arranged, the cleaner may reduce a user's inconvenience.

As a result, a cleaner is provided in which the number and position of paths may easily be controlled.

A cleaner having a simple primary dust separation structure is provided, to contain more dust in a dust box.

In detail, an embodiment of the present disclosure provides a cleaner comprising a main body including an suction inlet through which the air containing dust enters, a dust separator provided to separate dust from the air while the air entering from the suction inlet is moving, a first dust collector collecting the dust separated by the dust separator, a cyclone movably rotating the air, which has passed through the dust separator, to separate the dust from the air, and a second dust collector collecting the dust separated by the cyclone portion, wherein the dust separator is provided with a plurality of plate shaped members arranged to have a predetermined angle with respect to a moving direction of the air, and the plurality of plate shaped members are arranged to be spaced apart from one another to move the air.

The cyclone portion is arranged in a plural number in a direction vertical to the moving direction of the air.

The cleaner further comprises tapered portions respectively extended from both sides of the suction inlet to both sides of the cyclone portion based on a width direction of the main body.

The plurality of plate shaped members are arranged between the tapered portions.

The respective plate shamed members are arranged in parallel with each other.

The cleaner includes a communication hole through which the air enters the cyclone portion, and an extension portion formed to be extended from the communication hole to the suction inlet, wherein the plurality of plate shaped members are formed to be spaced apart from an end of the extension portion in a direction of the suction inlet.

The cyclone portion includes a vane guiding the air to be rotated in the communication hole, a cyclone housing surrounding the vane, and a discharge hole inserted into the cyclone housing to guide the air from which dust is separated.

The cyclone housing has a conical pillar shape.

The first dust collector is arranged below the dust separator with respect to a height direction of the main body, and the main body includes a protrusion extended from a lower side of the suction inlet to the inside of the main body based on the height direction of the main body to allow the dust entering the first dust collector not to move to the cyclone portion.

The dust separator is provided such that the plurality of plate shaped members are arranged at certain intervals in a direction of the suction inlet, and the dust separator is provided in a plural number.

If the dust separator is provided in a plural number, the dust separators are arranged to be partially overlapped with each other.

Another embodiment of the present disclosure provides a cleaner comprising a main body including an suction inlet through which the air containing dust enters, a dust separator provided to separate dust from the air while the air entering from the suction inlet is moving, a first dust collector collecting the dust separated by the dust separator, a cyclone movably rotating the air, which has passed through the dust separator, to separate the dust from the air, a partition wall formed between a lower side of the suction inlet and the cyclone portion based on a height direction of the main body, and a second dust collector provided below the partition wall, collecting the dust separated by the cyclone portion, wherein the dust separator is provided in the partition wall to be communicated with the first dust collector, and is provided to have a predetermined height from the partition wall.

The cyclone portion is arranged in a plural number in a direction vertical to a moving direction of the air.

The cleaner further comprises tapered portions respectively extended from both sides of the suction inlet to both sides of the cyclone portion based on a width direction of the main body.

The dust separator is arranged between the tapered portions.

The dust separator has a width equal to or greater than that of the suction inlet.

The dust separator is provided to have a curvature radius.

The cleaner further comprises a vane guiding the air to be rotated in the communication hole, a cyclone housing surrounding the vane, and a discharge hole inserted into the cyclone housing to guide the air from which dust is separated.

The cyclone housing has a conical pillar shape.

Advantageous Effects

According to the embodiments of the present disclosure, even though a direct connection structure for allowing the air to enter the inside of a cleaner is not provided, dust separation performance is excellent, whereby utility of an inner space of a main body may be enhanced.

Therefore, a cleaner may make sure of a variety of shapes.

Also, since dust is separated through a simple structure, easiness in manufacture may be obtained.

DETAILED DESCRIPTION

Hereinafter, the embodiments of the present disclosure will be described with reference to the accompanying drawings. The following detailed description is provided to assistant full understanding of a method, apparatus and/or system disclosed in the present disclosure. However, this is only exemplary, and the present disclosure is not limited to the following description.

In describing the embodiments of the present disclosure, if detailed description of elements or functions known in respect of the present disclosure is not relevant to the subject matter of the present disclosure, the detailed description will be omitted. The terms which will be described later are selected from generally known and used terms considering their functions in the present disclosure, and may be modified depending on intention of a person skilled in the art, practices, or the like. Accordingly, the terms used herein should be understood not simply by the actual terms used but by the meaning lying within and the description disclosed herein. The terms used herein are intended to describe the embodiments of the present disclosure, and should not be restrictive. It is to be understood that the singular expression used in this specification includes the plural expression unless defined differently on the context. In this description, it is to be understood that the terms such as "include" and "has" are intended to designate that features, numbers, steps, operations, elements, parts, or their combination, which are disclosed in the specification, exist, and are intended not to previously exclude the presence or optional possibility of one or more other features, numbers, steps, operations, elements, parts, or their combinations.

Figure 1:
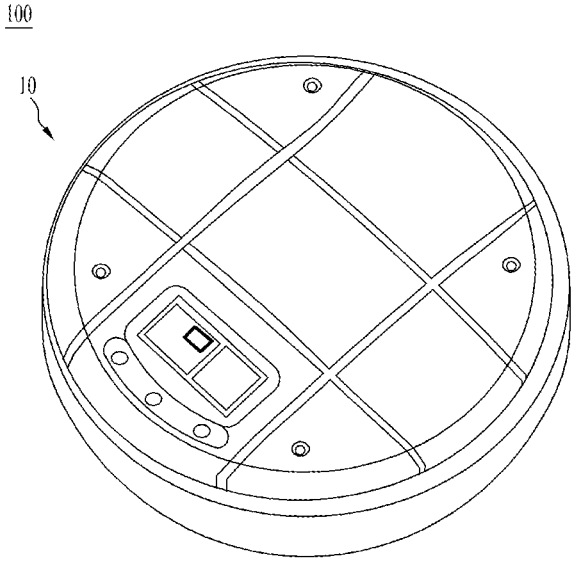
FIG. 1 is a perspective view illustrating a cleaner according to the embodiment of the present disclosure.

FIG. 1 is a perspective view illustrating a cleaner according to the embodiment of the present disclosure.

A cleaner 100 according to the embodiment of the present disclosure may include a main body 10, a driving unit (not shown), and a sensing unit (not shown).

The cleaner 100 may further include a battery (not shown) for providing a power to electrically operate the driving unit and the sensing unit. The battery may be made of a secondary battery and may repeatedly be charged. Therefore, a user may use the battery even without exchanging or adding the battery when a remaining level of the battery is low.

The cleaner 100 may be charged by being coupled to a charging stand (not shown). The charging stand may be formed to correspond to at least a portion of an external appearance of the cleaner 100. Therefore, the cleaner 100 may stably be coupled to the charging stand.

The main body 10 may provide a space in which components of the cleaner 100 according to one embodiment of the present disclosure is built.

Also, the driving unit and the sensing unit may be coupled to the main body 10. The main body 10 may be a portion for forming the external appearance of the cleaner 100. A size or shape of the cleaner 100 may be determined naturally if a size or shape of the main body 10 is determined.

The main body 10 may be provided such that internal components are not exposed to the outside. The cleaner 100 may perform its functions in such a manner that several components are connected with one another as described above.

When the components operate, a user's body may be hurt due to the user's carelessness or error operation. Therefore, the main body 10 may cover the internal components to prevent negligent accident. Also, since complex internal components are not exposed to the outside due to the presence of the main body 10, the main body 10 may be used as a design element having a sense of beauty.

Although not shown, the cleaner 100 may clean a mounting surface on which the cleaner 100 is mounted. That is, the cleaner 100 may clean a cleaning target area along the mounting surface.

The driving unit may move the main body 10. Therefore, the driving unit is preferably provided in the form of wheel. The driving unit may be provided at both sides of the main body 10.

Each driving unit may be operated by each motor different from another motor. That is, each driving unit at both sides may be controlled to be rotated at a different rotational speed. Therefore, the cleaner 100 may be rotated in a left or right direction. Also, the cleaner 100 is provided to enable direction switching during forward driving or backward driving.

That is, a driving speed of the cleaner 100 may be determined in accordance with a rotational speed of the driving unit, and a driving direction of the cleaner 100 may be determined by a difference in a rotation speed of the driving units.

For example, if the left driving unit maintains a stop state and the right driving unit is rotated, the cleaner 100 may be rotated in a left direction. If both driving units operate but the left driving unit is rotated to be faster than the right driving unit, the cleaner 100 may continue to drive in forward motion by direction switching to the left side.

Also, the driving unit may be provided in the form of a roller and a chain, which are connected to each other, as well as in the form of a wheel.

The sensing unit may collect information required for self-driving of the cleaner 100. For example, the sensing unit may include a camera sensor (not shown) making a driving map by taking a periphery, for example, a floor sensor (not shown) sensing a material of a floor, and an obstacle sensor sensing obstacles. Also, the sensing unit may further include additional sensors in addition to the aforementioned sensors.

For example, the sensing unit may further include a wall sensor (not shown). Therefore, information on a cleaning target area may be input to the cleaner 100 through the wall sensor and the camera sensor. The cleaner 100 may input a shape of a space while driving and partitions the cleaning target area through the wall sensor to form a plurality of cleaning areas.

However, the aforementioned example is only exemplary, and the camera sensor and the obstacle sensor (not shown) may perform wall sensing at the same time.

The camera sensor may be provided to specify a position of the main body 10 in a cleaning target area which is previously input as well as sense the cleaning target area. Therefore, the position of the space where the cleaner 100 is perform cleaning may be specified, whereby motion to next cleaning area may be guided.

There is no limitation in the number and type of camera sensors. That is, a plurality of camera sensors may be provided, and in this case, homogeneous or heterogeneous camera sensors may be provided.

A driving intensity of a dust suction unit may be varied depending on a material of a floor material to effectively suck dust. For example, the dust suction unit should be operated more strongly on an area that is carpeted than a general area where a floorboard is laid, whereby cleaning may be performed effectively.

The obstacle sensor may identify the presence of an obstacle existing in the cleaning target area. The obstacle sensor may be provided in a single body with the camera sensor, or may be provided separately from the camera sensor. That is, the camera sensor may also serve as the obstacle sensor.

Figure 2:
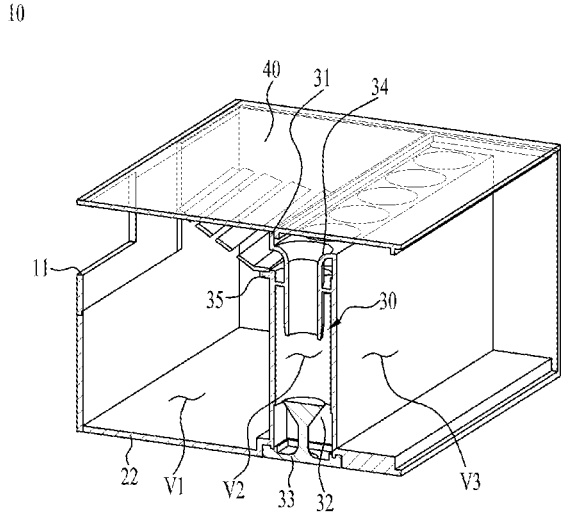
FIG. 2 is a cross-sectional view illustrating a main body of a cleaner according to the embodiment of the present disclosure.
Figure 3:
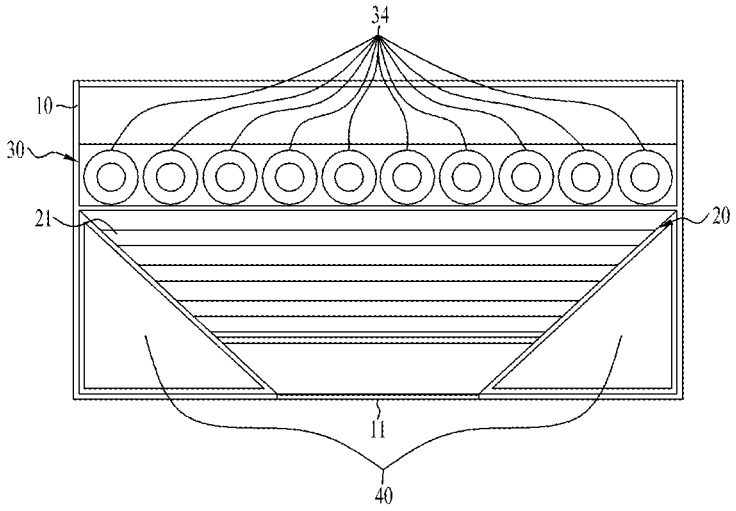
FIG. 3 is a plane view illustrating a cleaner according to the embodiment of the present disclosure.

FIG. 2 is a cross-sectional view illustrating a main body of a cleaner according to the embodiment of the present disclosure, and FIG. 3 is a plane view illustrating a cleaner according to the embodiment of the present disclosure.

In detail, FIG. 2 is a view illustrating a portion of the main body 10 of the cleaner 100 according to this embodiment. FIG. 2 briefly illustrates the main body 10 of the cleaner 100 for clear understanding of the present disclosure but the cleaner 100 is not configured only by the disclosure shown in FIG. 2. Therefore, separate elements which are not shown in FIG. 2 may be provided additionally at a level easy for a person with ordinary skill. That is, although not shown in FIG. 2, the cleaner may further include not only elements for operating the cleaner 100 but also various elements for user's convenience.

FIG. 2 may be a cross-sectional view for a center in a width direction of the cleaner 100.

The main body 10 may include a suction inlet 11 through which the air containing dust is sucked. The cleaner 100 may include a suction nozzle (not shown) for sucking dust on the mounting surface on which the cleaner 100 is mounted. The suction inlet 11 may be provided to allow the air containing dust sucked through the suction nozzle to enter the inside of the main body 10. That is, the suction inlet 11 may serve to communicate the inside of the main body 10 with the outside of the main body 10.

A separate guide unit (not shown) may be provided between the suction inlet 11 and the suction nozzle. Therefore, this embodiment may be applied to a handy type cleaner or a stick type cleaner as well as a robot cleaner operated automatically.

The suction inlet 11 may be formed to adjoin an upper surface of the main body 10 in a height direction. Preferably, the suction inlet 11 may be formed to be opened on the upper surface of the main body 10. The reason why that the suction inlet 11 is formed at the upper side of the main body 10 in a height direction may be intended to effectively separate dust through the dust separator 20, which will be described later.

The inside of the main body 10 may be categorized into a first space V1, a second space V2 and a third space V3.

In detail, the first space V1 may be a space where the dust separator 20 and a first dust collector 22 are provided. The second space V2 is communicated with the first space V1, and may be a space where a cyclone 30 is provided. The third space V3 is communicated with the second space V2, and may be a space to which the air separated from dust in the cyclone portion 30 is discharged.

The first space V1 may be provided with the dust separator 20. The dust separator 20 may be arranged on a moving path of the air from the suction inlet 11. In detail, if the air containing dust enters the first space V1 through the suction inlet 11, the dust separator 20 may be arranged such that the moving path may be changed as the air moves and adjoins the dust separator 20.

Dust of various sizes may be included in the air entering the first space through the suction inlet 11. For example, the air may include particles, such as lint and hair, which may be identified visibly, or may include fine dust which is not visible to eyes.

The dust separator 20 may be a portion where dust is primarily filtered from the air containing dust. The dust separator 20 may serve to separate dust relatively heavy or greater (or dust which is heavy and greater in size) from dust contained in the air.

Hereinafter, a detailed structure for a function of the aforementioned dust separator 20 will be described with reference to FIGS. 2 and 3.

The dust separator 20 may be provided at an upper side of the first space V1. Preferably, the dust separator 20 may be provided in parallel with the suction inlet 11 along a length direction of the main body 10 such that most of the air from the suction inlet 11 may adjoin the dust separator 20.

The dust separator 20 may be provided as a plurality of plate shaped members 21. The dust separator 20 may be provided in such a manner that a plurality of plated shaped members 21 are arranged to have a predetermined angle with respect to a moving direction of the air.

The plurality of plate shaped members 21 may be arranged to be spaced apart from one another. In other words, the plurality of plate shaped members 21 may be arranged to have a predetermined angle with respect to a moving direction of the air from the suction inlet 11, or may be arranged to be spaced apart from one another.

As the plate shaped members 21 are provided to have a predetermined angle with respect to the moving direction of the air, relatively heavy dust or relatively big dust from dust contained in the air may be separated toward a downward direction of the main body 10.

Hereinafter, arrangement of the plurality of plate shaped members 21 will be described in detail.

The plate shaped members 21 may be provided in the form of a plate (or panel) in which a length in a width direction of the main body 10 is longer than a length in a length direction of the main body 10. The plate shaped members 21 are shown in the form of a rectangular shape but are not limited thereto.

The plate shaped members 21 may be provided such that the length in a width direction of the main body 10 becomes shorter toward the suction inlet 11. The plate shaped members 21 may be provided such that the length in a width direction of the main body 10 becomes longer toward the second space V2 from the suction inlet 11. This is because that the plate shaped member 21 is arranged between tapered portions 40 which will be described later.

In detail, the tapered portions 40 may be formed to be extended from both sides of the suction inlet 11 to the inside of the main body 10. The tapered portions 40 may be extended to be inclined toward both sides of the main body 10 from both sides of the suction inlet 11. Both sides of the main body 10 may mean both surfaces in a width direction of the main body 10. That is, the tapered portions 40 may be extended toward a length direction of the main body 10, and may be extended to have a predetermined slope with respect to a longitudinal shaft of the main body 10.

In this specification, the terms such as a front direction and a rear direction mean that a point where the suction inlet 11 is located is referred to as the front direction and a direction opposite to the suction inlet 11 or a direction where the air is discharged is referred to as the rear direction, and do not mean a direction of the main body 10 which is shown. Therefore, the front direction or the rear direction may be described as another direction depending on a direction of the suction inlet 11.

A detailed description of the tapered portions 40 will be given later.

The plate shaped members 21 may be arranged to be spaced apart from one another at a predetermined distance. In detail, the plate shaped members 21 may be spaced apart from one another at a predetermined distance along a length direction of the main body 10. Also, the plate shaped members 21 may be spaced apart from one another along a height direction of the main body 10.

As a result, the spaces among the plate shaped members 21 may be obtained to provide a path through which the air containing dust may flow.

The plate shaped members 21 may be arranged to have constant intervals but is not limited thereto. The distances among the plate shaped members 21 may be different from one another. The plate shaped members 21 may be varied in lengths in a width direction of the main body 10 depending on their arrangement positions as described above. Therefore, the spaced distances among the plate shaped members 21 may be varied to detect a proper position where dust may be separated, to correspond to the arrangement positions.

In conclusion, the plate shaped members 21 may be arranged to have a predetermined angle with respect to a moving direction of the air. The plate shaped members 21 may be spaced apart from one another at a predetermined distance along a longitudinal shaft of the main body 10, or may be spaced apart from one another at a predetermined distance along a height directional shaft of the main body 10.

Therefore, the air may move to the spaces among the plate shaped members 21, and the air entering the suction inlet 11 collides with the plate shaped members 21 in accordance with the arrangement of plate shaped members 21, whereby relatively larger dust may be dropped to the first space V1, specifically the first dust collector, and the air may enter the cyclone portion 30 due to its moving path changed by the plate shaped members 21.

The tapered portions 40 may be portions extended from both sides in a width direction of the suction inlet 11 to the inside of the main body 10 to have a slope in a width direction as described above.

The suction inlet 11 may be provided to be smaller than a width length of the main body 10. If the suction inlet 11 is formed to be narrower, a suction speed becomes fast when a suction power acts, whereby the suction inlet 11 may be favorable for cleaning. However, if the suction inlet 11 becomes narrow, a flow rate of the air may be reduced.

Therefore, the tapered portions 40 may be provided for effective air flow. As the tapered portions 40 are provided, rapid pressure drop of the air may be avoided. Therefore, dust contained in the air may be prevented from being unexpectedly discharged, and dust may be separated effectively.

Also, the tapered portions 40 may be formed to be extended from the upper surface of the main body 10 to the lower end of the suction inlet 11. That is, the tapered portions 40 may be provided inside the main body 10 in the form of a prism. The tapered portions 40 may be arranged at both sides based on the center of the suction inlet 11 inside the main body 10 in the form of a prism.

As described above, as the dust separator 20 is simply provided, the first space V1 may be used widely, the size of the first dust collector 22 may be increased. Therefore, the cleaner 100 may be used for a long time without frequently removing dust stacked therein.

The cyclone portion 30 may be provided in a rear direction of the dust separator 20. The air primarily filtered from the air containing dust, which is relatively great or heavy, by the dust separator 20 may enter the cyclone portion 30.

The cyclone portion 30 may include a communication hole 31 communicated with the first space V1, a vane 321 guiding the air from the communication hole 31 to be rotated, a cyclone housing 32 provided to surround the vane 321, and a discharge hole 34 inserted into the cyclone housing 32 to guide the air from which dust is separated.

Also, the cleaner 100 according to the present disclosure may include a second dust collector 33 provided below the cyclone portion 30 to collect dust separated from the cyclone portion 30.

The communication hole 31 may be a portion where the air enters the cyclone housing 32. The communication hole 31 may be arranged in a rear direction of the dust separator 20 such that the air passing through the dust separator 20 may naturally enter the cyclone portion 30.

In detail, the plate shaped member 21 arranged at the last rear end among the plurality of plate shaped members 21 may be connected to an extension portion 35 formed to be extended from the communication hole 31 to the suction inlet 11. The other plate shaped members 21 may be arranged at a predetermined intervals based on the plate shaped member 21 arranged at the last rear end.

The air entering through the communication hole 31 may movably be rotated along the vane 321 formed inside the cyclone portion 30. The air is rotated inside the cyclone portion 30 by the vane 321 and dust that becomes heavy by the air may collide with the cyclone housing 32 and then may be dropped downward.

Therefore, dust may be separated and then collected in the second dust collector 33.

The air from which the dust is separated may be discharged to the third space V3 through the discharge hole 34. Although the drawings of this specification show that the inside of the third space V3 is empty, the present disclosure is not limited thereto.

The discharge hole 34 may be provided to be inserted into the cyclone housing 32.

That is, a separate element for driving the cleaner may be arranged in the third space V3, or a discharge outlet (not shown) may be formed in the third space V3 may be arranged therein to discharge the air, from which the dust is separated, to the outside of the main body 10.

The cyclone portion 30 may be provided in a plural number in a direction perpendicular to a moving direction of the air. In other words, the cyclone portion 30 may be provided based on a width direction of the main body 10.

Therefore, the air entering through suction hole 11 may be prevented from being stacked.

Figure 4:
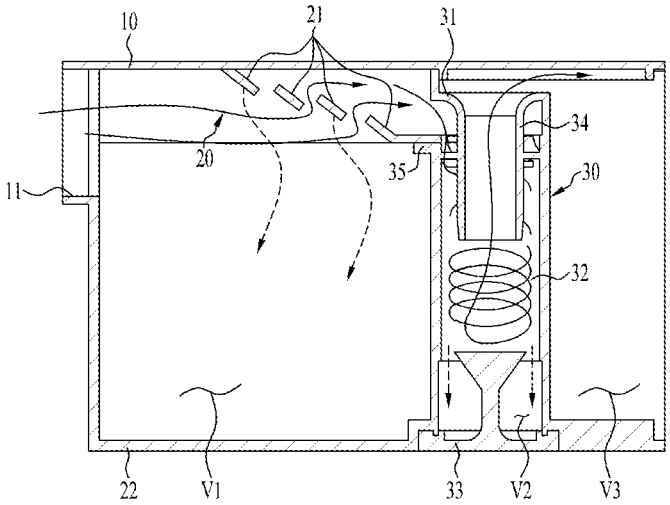
FIG. 4 is a view illustrating a suction air flow of a cleaner according to the embodiment of the present disclosure.

FIG. 4 is a view illustrating a suction air flow of a cleaner according to the embodiment of the present disclosure.

Referring to FIG. 4, the air may enter the cleaner through the suction hole 11 and move along a length direction of the main body 10.

When the air moves inside the main body 10, the air separator 20 may collide with the plate shaped members 21. If the air collides with the plate shaped members 21, the light air may move to the spaces among the plate shaped members 21. However, if the dust which is great or heavy collides with the plate shaped members 21, the dust may be dropped downward.

Therefore, the dust may be separated through a simple structure even without using a member such as a filter or mesh.

The air passing through the dust separator 20 may enter the cyclone portion 30 through the communication hole 31.

In detail, the air passing through the dust separator 20 may enter the cyclone portion 30 through the communication hole and then be guided by the vane 321.

The vane 321 may be provided to be rotated along an inner surface of the cyclone housing 32. If the air is guided through the vane 321, the air may be dropped while being rotated along the cyclone housing 32. At this time, a centrifugal force may be generated, and the dust may collide with the inner surface of the cyclone housing 32 in accordance with the centrifugal force.

Although there is no limitation in the shape of the cyclone housing 32, if the cyclone housing 32 is provided in the form of a conical pillar as described later, the inner surface of the cyclone housing 32 may be provided to have a predetermined slope toward the inner side of the cyclone housing, whereby the dust may be prevented from being spread or discharged to the third space V3 along an ascending flow of the air.

The air from which the dust is separated may move to the upper side of the cyclone housing 32 and get out of the second space V2 through the discharge hole 34. As a result, as the dust is primarily separated by the dust separator 20 and secondarily separated through the cyclone portion 30, the clean air may be discharged to the outside of the main body 10.

Figure 5:
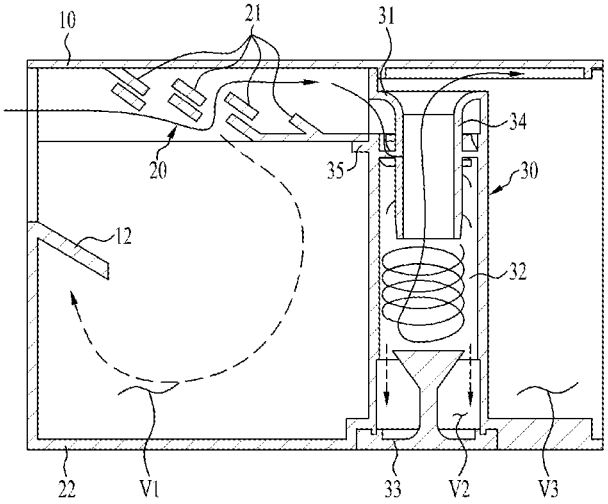
FIG. 5 is a view illustrating a protrusion of a cleaner according to another embodiment of the present disclosure.

FIG. 5 is a view illustrating a protrusion of a cleaner according to another embodiment of the present disclosure.

Prior to description of FIG. 5, a description for a portion repeated with FIGS. 3 and 4 will be omitted. Therefore, details which will not be described hereinafter are not excluded from the embodiment of the present disclosure.

The cleaner 100 according to another embodiment may include a protrusion 12.

The protrusion 12 may be a portion extended from the lower side of the suction inlet 11 to the inside of the first space V1.

In detail, the protrusion 12 may be a portion extended to be downwardly inclined toward the inside of the main body 10 from the lower side of the suction inlet 11 based on a height direction of the main body 10.

Cleaning efficiency deterioration caused by re-ascending of the dust may be avoided by the protrusion 12.

In detail, the air entering through the suction inlet 11 enters the inside of the main body 10 and collides with the dust separator 20. In this case, some of the air as well as the dust is moved downward by the plate shaped members 20. Even though the air is moved downward, the air may ascend along the air flow.

At this time, the dust may again ascend along the air and be moved to the dust separator 20. If the dust is again separated by the dust separator 20, the dust does not enter the cyclone portion 30, whereby a user may not feel a difference in view of effect. However, it is not preferable to filter the same dust several times.

Also, if the dust is repeatedly separated, the dust may enter the spaces among the plate shaped members 21 unexpectedly. In this case, the effect of the dust separator 20 in the main body 10 may be reduced.

Therefore, the protrusion 12 may be provided to prevent the dust from ascending along with the air.

The protrusion 12 may be extended to be downwardly inclined toward the inside of the main body 10 but is not limited thereto. However, considering the flow of the air, if the protrusion 12 is provided to be upwardly inclined toward the inside of the main body 10, the separated dust may be guided to the air that moves to the suction inlet 11. Therefore, it is not preferable that the protrusion 12 is extended to be upwardly inclined toward the inside of the main body 10.

That is, it is preferable that the protrusion 12 is provided to be extended toward the inside of the main body 10 along the length direction of the main body 10 or inclined downward based on the height direction of the main body 10.

The dust separator 20 may include the plurality of plate shaped members 21. In detail, the plate shaped members 21 may be provided to be spaced apart from one another at a predetermined interval as described above.

The plurality of plate shaped members 21 may be spaced apart from one another at certain intervals in a direction of the suction inlet 11 and spaced apart from one another at certain intervals toward the height direction of the main body 10. At this time, if the plate shaped members 21 spaced apart from one another at certain intervals in a direction of the suction inlet 11 and spaced apart from one another at certain intervals toward the height direction of the main body 10 are expressed by one dust separator 20, the cleaner 100 according to the embodiment of the present disclosure may include a plurality of dust separators 20.

In detail, the plurality of plate shaped members 21 may further be provided in a shape the same as or similar to the spaced shape among the plate shaped members 21 of one dust separator 20.

That is, the plate shaped members 21 may be provided to allow the air passing through the spaces among the plate shaped members 21 of the dust separator 20 to form a more complicated path, thereby maximizing dust separation efficiency.

Although FIG. 5 shows that two dust separators 20 are provided, the present disclosure is not limited to the example of FIG. 5. That is, the dust separator 20 may be provided in a plural number.

In more detail, the air paths (the spaces among the plate shaped members) formed by one dust separator 20 may be arranged to be partially covered by another dust separator 20.

Therefore, if the air enters the suction inlet 11, the moving path of the air may be changed by the plate shaped members 21 with which the air first collides on the moving path, and then may be changed by the plate shaped members 21 with which the air again collides.

If the air enters the inside of the main body 10 and the moving path of the air is changed by the plate shaped members 21 several times, the dust may more effectively be separated from the air containing the dust entering the suction inlet 11.

The plate shaped members 21 between the dust separators 20 may be provided to change the moving path of the air. That is, the plate shaped members 21 between the dust separators 20 may be provided such that the spaces among the plate shapes 21 formed by one dust separator 20 may be covered by the plate shaped members 21 of another dust separator 20. In other words, another dust separator 20 may be provided to be partially overlapped with each of the plate shaped members 21 of one dust separator 20.

Afterwards, the air flow in the cyclone portion 30 has been described as above and thus will be omitted.

Figure 6:
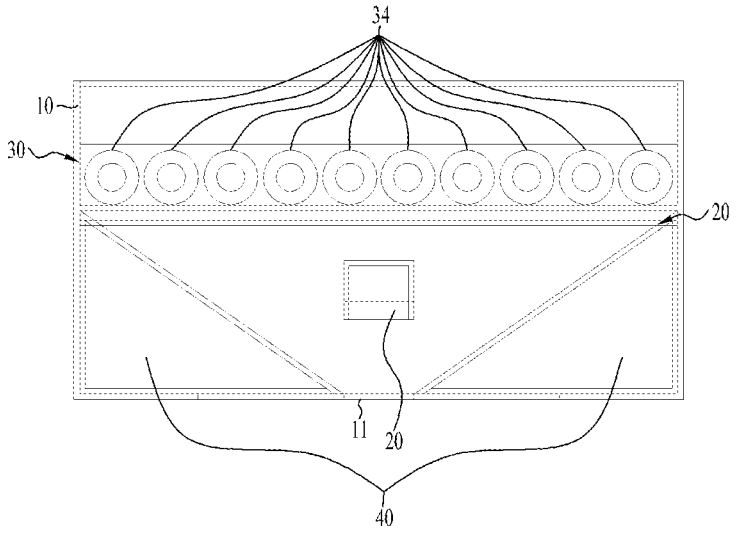
FIG. 6 is a plane view illustrating a cleaner according to still another embodiment of the present disclosure.
Figure 7:
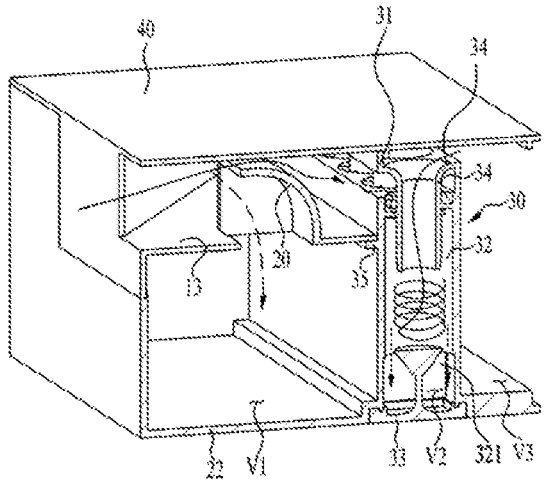
FIG. 7 is a cross-sectional view illustrating a cleaner according to further still another embodiment of the present disclosure.

FIG. 6 is a plane view illustrating a cleaner according to still another embodiment of the present disclosure, and FIG. 7 is a cross-sectional view illustrating a cleaner according to further still another embodiment of the present disclosure.

Hereinafter, the cleaner 100 according to another embodiment of the present disclosure will be described with reference to FIGS. 6 and 7. A description of a repeated portion will be omitted.

The cleaner 100 according to another embodiment of the present disclosure may include a partition wall 13 formed in the first space V1.

The partition wall 13 may be provided in the first space V1.

In detail, the partition wall 13 may be formed to be extended along the length direction of the main body 10 between the suction inlet 11 and the cyclone portion 30. In more detail, the partition wall 12 may be provided to connect the cyclone housing 32 with the suction inlet 11.

The partition wall 13 may be provided to be extended from the lower side of the suction inlet 11 to the cyclone portion 30 based on the height direction of the main body 10.

If the partition wall 13 is provided, the first space V1 may be partitioned by the partition wall 13. The lower side based on the partition wall 13 may be categorized into the first dust collector 22, and the upper side based on the partition wall 13 may be categorized into a portion for providing the moving path of the air.

The partition wall 13 may be provided with the dust separator 20 provided to communicate the upper side of the partition wall 13 with the lower side of the partition wall 13.

The dust separator 20 of this embodiment may be provided to have a predetermined height from the partition wall 13.

The dust separator 20 may be extended from the partition wall 13 to the upper side of the main body 10, and may be provided to have a curvature radius. As the dust separator 20 is provided to have a curvature radius, the dust may be guided naturally without generating vortex with the air even though the air entering through the suction inlet 11 collides with the dust separator 20.

The uppermost end of the dust separator 20 may be provided to be spaced apart from the upper surface in the height direction of the main body 10 at a predetermined distance so as not to adjoin the corresponding upper surface. This is because that the case that the dust separator 20 is provided to be in contact with the upper surface of the main body 10 may disturb the moving path of the air.

Therefore, generation of vortex may be restrained by disturbing the moving path of the air.

According to this embodiment, a width at both sides of the suction inlet 11 may be equal to or greater than a width of the dust separator 20 based on the width direction of the main body 10.

Therefore, the air entering through the suction inlet 11 may collide with the dust separator 20 as much as possible, whereby the dust may primarily be filtered.

A sectional area where the air moves may gradually be widened through the tapered portions 40. Therefore, even though the sectional area is provided to be wider than the width of the suction inlet 11, the air is guided by the tapered portion 40, whereby the dust separator 20 may effectively separate the dust.

It may be difficult to fully separate the dust from the air entering through the suction inlet 11 through the dust separator 20. However, it is more preferable to allow the air to enter the cyclone portion 30 after primarily removing some dust than the case that dust of which particle is great in size or relatively heavy (or dust which is great or heavy) is not filtered primarily.

Therefore, it is preferable that the dust separator 20 is provided inside the main body 10 even though the dust separator 20 does not remove 100% of dust. As the dust separator 20 is provided, dust may be separated through a simple structure.

The air from which dust is primarily separated by the dust separator 20 enters the cyclone portion 30 and then the dust is secondarily separated from the air. Afterwards, the air may be discharged to the third space V3.

FIG. 8 is a view illustrating a cyclone of a cleaner according to the embodiment of the present disclosure.

Hereinafter, a shape of the cyclone portion 30 will be described with reference to FIG. 8.

Figure 8A:
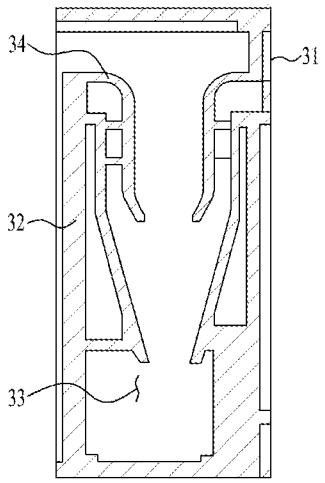
FIGS. 8A, 8B, 8C, and 8D are views illustrating a cyclone of a cleaner according to embodiments of the present disclosure.
Figure 8B:
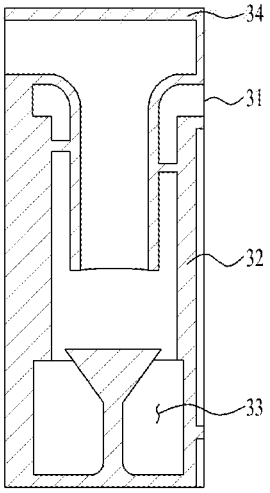

FIG. 8A illustrates a cyclone 30 provided in an axial flow manner, and FIG. 8B illustrates a cyclone 30 provided in a swirl tube manner.

Figure 8C:
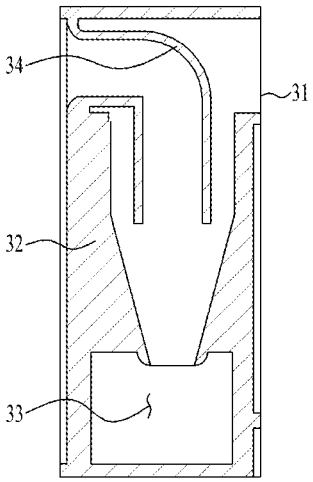
Figure 8D:
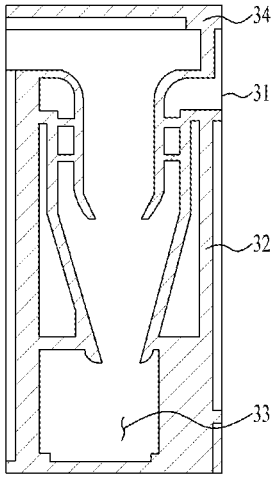

FIGS. 8C and 8D illustrate various shapes of the discharge hole 34.

As described above, the cyclone portion 30 may include a communication hole 31, a vane 321, a cyclone housing 32, and a discharge hole 34.

The communication hole 31 is a hole for communicating the second space V2 with the first space V1, and may be a portion where the air enters the second space V2. The communication hole 31 may be formed at one side of an outer surface of the cyclone housing 32 to allow the air of the first space V1 to enter there.

The vane 321 may be a portion provided to be rotated by the air entering there. The air may be guided through the vane 321, and may generate a centrifugal force by rotation. The air which is relatively heavy may collide with the outer surface of the cyclone housing through the centrifugal force and then descend.

As a result, the dust may be separated from the air.

The cyclone housing 32 may be provided to have a sectional area that is narrower along an inflow direction of the air. For example, the cyclone housing 32 may be provided in a conical shape having a lower sectional area and an upper sectional area wider than the lower sectional area based on the height direction of the main body 10.

If the cyclone housing 32 is provided in a conical shape, the dust naturally may descend along the inner surface of the cyclone housing 32, whereby the dust may be likely to be collected in the second dust collector 33.

However, the cyclone housing 32 may be provided in a cylindrical shape without limitation to the conical shape. This is because that the air may naturally be rotated by the vane 321 even though the cyclone housing 32 is provided in a cylindrical shape.

The discharge hole 34 may be a portion provided to allow the air from which dust is separated in the cyclone housing 32 to get out of the second space V2. The discharge hole 34 may be provided to connect the second space V2 with the third space V3.

The discharge hole 34 may be provided to be inserted into the cyclone housing 32 to allow the air from which dust is separated to enter there.

The discharge hole 34 may be provided in a shape different from the shapes shown in FIGS. 8D and 8D. That is, there is no limitation in the shape of the discharge hole 34.

In detail, the shape of the discharge hole 34 may be changed depending on a detailed structure or design change of the cleaner 100. As described above, the third space V3 may be provided in various shapes such as a portion required for driving of the cleaner 100 or a portion for discharging the air to the outside of the main body 10.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A cleaner comprising:

a main body including a suction inlet configured to allow air containing dust to enter into the main body;

a dust separator configured to separate dust from the air;

a first dust collector configured to collect the dust separated by the dust separator;

a cyclone portion configured to rotate the air, which has passed through the dust separator, to separate additional dust from the air; and a second dust collector configured to collect the additional dust separated by the cyclone portion, wherein the dust separator includes a plurality of plate shaped members arranged to have a predetermined angle with respect to a moving direction of the air, and the plurality of plate shaped members are arranged to be spaced apart from one another, wherein the plurality of plate shaped members are arranged in parallel with each other between tapered portions, and wherein the plurality of plate shaped members are provided such that a length thereof in a width direction of the main body becomes shorter toward the suction inlet.

2. The cleaner of claim 1, wherein the cyclone portion comprises a plurality of cyclone portions arranged along a direction perpendicular to the moving direction of the air.

3. The cleaner of claim 2, wherein the tapered portions extend from both sides of the suction inlet to both sides of the cyclone portion, the tapered portions being tapered along a width direction of the main body.

4. The cleaner of claim 1, wherein the cyclone portion includes:

a communication hole configured to allow the air to enter the cyclone portion; and an extension portion extending from the communication hole to the suction inlet, and wherein the plurality of plate shaped members are spaced apart from an end of the extension portion adjacent to the suction inlet.

5. The cleaner of claim 4, wherein the cyclone portion further includes:

a vane configured to rotate the air in the communication hole;

a cyclone housing disposed around the vane; and a discharge hole disposed in the cyclone housing to guide the air from which dust is separated.

6. The cleaner of claim 5, wherein the cyclone housing has a conical pillar shape.

7. The cleaner of claim 1, wherein the first dust collector is arranged below the dust separator with respect to a height direction of the main body, and the main body further includes a protrusion extending from a lower side of the suction inlet to the inside of the main body, the protrusion being configured to at least partially restrict the dust entering the first dust collector from moving to the cyclone portion.

8. The cleaner of claim 1, wherein the plurality of plate shaped members are arranged spaced apart at predetermined intervals along a direction from the suction inlet towards the dust separator, and the dust separator comprises a plurality of dust separators.

9. The cleaner of claim 8, wherein the plurality of dust separators are arranged to partially overlap with each other.

* * * * *